United States Patent [19]

Nahmiaj

[11] Patent Number: 4,986,363

[45] Date of Patent: Jan. 22, 1991

[54] FIRE FIGHTING PROCESS AND USE OF THE METHOD

[75] Inventor: Jean Nahmiaj, Paris, France

[73] Assignee: Cereberus Guinard, Buc, France

[21] Appl. No.: 224,574

[22] Filed: Jul. 26, 1988

[30] Foreign Application Priority Data

Jul. 30, 1987 [FR] France ..... 87 10803

[51] Int. Cl.[5] ..... A62C 2/00; A62C 3/02

[52] U.S. Cl. ..... 169/46; 169/43; 169/45

[58] Field of Search ..... 169/46, 43, 45, 47

[56] References Cited

U.S. PATENT DOCUMENTS

| | | | |
|---|---|---|---|
| 2,858,895 | 11/1958 | Connell | 169/45 |
| 3,684,019 | 8/1972 | Emmons et al. | 169/47 |
| 4,616,711 | 10/1986 | Johnson | 169/45 |

*Primary Examiner*—Joseph F. Peters, Jr.
*Assistant Examiner*—Anne E. Bidwell
*Attorney, Agent, or Firm*—Eckert Seamans Cherin & Mellott

[57] ABSTRACT

The invention relates to a fire fighting process, characterized in that it consists of using nonpropagative elements or of employing means for rendering the combustible elements non-propagative, in such a way that the percentage of non-propagative sites which the fire is liable to encounter is greater than a given threshold of less than 100%.

13 Claims, 1 Drawing Sheet

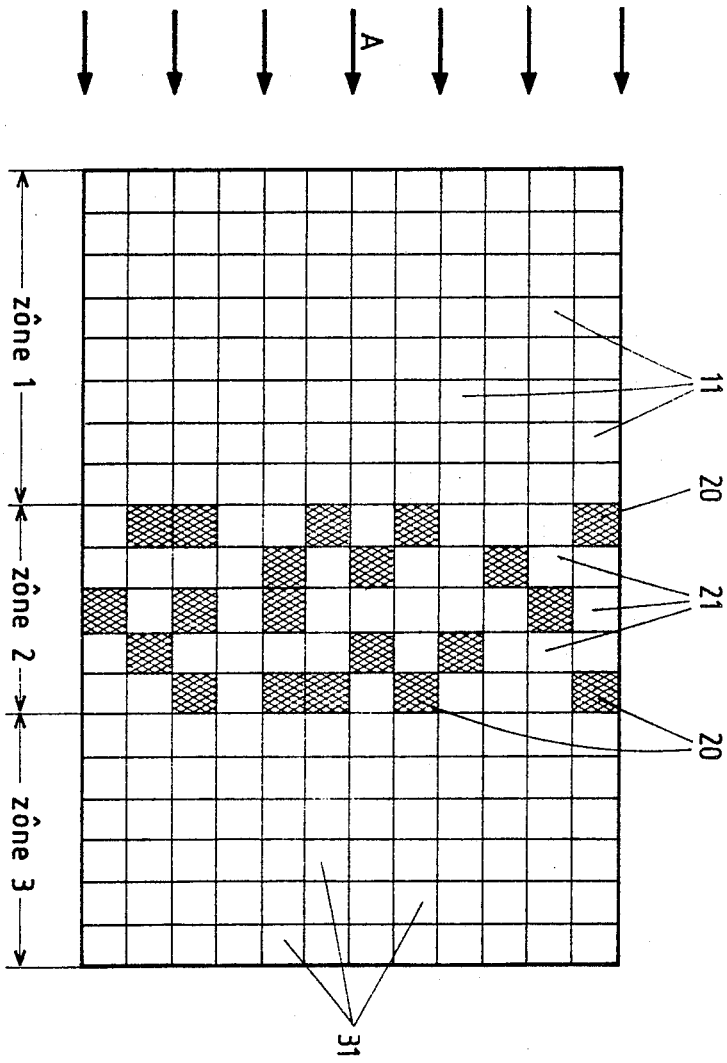
A
11
20
21
20
31
zône 1
zône 2
zône 3

FIRE FIGHTING PROCESS AND USE OF THE METHOD

This invention relates to a process for fighting fires, e.g. forest fires.

At present, the means for fighting forest fires, are based on two main principles. The first is preventive and consists of establishing zones in the forest in which the fuel encouraging a fire to progress (propagative element) is partially or completely removed (fire-break zone).

The second principle consists of fighting by actively working on the front of the fire so as to render the vegetation downstream of the fire noncombustible (non-propagative element) by the application of water, whether or not supplemented with retardant substances. This application is performed by aircraft or motor driven pumps in such a way that the wet zone is as continuous as possible, or even submerged in water.

These means for prevention and fire fighting have disadvantages. For example, the creation of firebreak zones requires the complete elimination of vegetation from areas which may be of considerable size, which is very costly and prejudicial to nature. Similarly, in the case where undergrowth clearance operations are carried out, to be effective, these have to be repeated very often, involving considerable cost. Finally, active intervention, to be effective, necessitates conditions in which the action is fast and accurate and the means are continuous and ample. These conditions often put the operators in danger, e.g. flying of aircraft at low altitude, and the proximity of a large number of persons to the fire.

Another disadvantage of the earlier art was principally the maximizing of the preventive or fire fighting means so as to be sure of stopping the fire.

A first aim of the invention is to propose a fire fighting process whereby the means for fighting the fire are optimized by applying the theory of percolation.

This first aim is achieved through the fact that the fire fighting process is characterized in that it consists of using non-propagative elements or of employing means for rendering the combustible elements non-propagative, so that the percentage of the non-propagative sites which the fire is likely to encounter is greater than a given threshold below 100%.

According to another characteristic for a given zone the number of propagative and non-propagative sites is greater than 150 and the number of non-propagative sites varies within a range of between 25 and 60% of the total number of sites.

According to another characteristic, this threshold varies within a range of between 25 and 60% for forest fires.

According to another characteristic, this threshold is preferably chosen equal to 42% to stop forest fires in the absence of wind.

Another purpose of the invention is to propose a preventive fire fighting process by optimizing the means.

This aim is achieved by the fact that the process according to the invention is characterized in that the non-propagative elements consist of non-combustible plants planted in the proportions indicated according to a random distribution, to optimize and reduce the costs of clearing undergrowth and creating fire break zones.

Another aim of the invention is to propose a process whereby the active means for fire fighting are optimized while reducing the dangers to the operators.

This aim is achieved through the fact that the means for the process of rendering the elements of a zone non-propagative consist of spray heads with jets of damping fluid, arranged in such a way that the area sprayed is greater than the given threshold.

According to another characteristic, the means for the process of rendering the elements of a zone non-propagative consist of transportable bombs or containers, thrown or released.

According to another characteristic, water or foam is used as a damping fluid, according to another characteristic, the damping fluid may contain retardants.

Other characteristics and advantages of this invention will become apparent upon reading the description below, with reference to the single figure showing the use of the process of the invention in fire fighting.

FIG. 1 represents the use of the percolation theory in a fire fighting process.

According to this theory, a propagative phenomenon such as fire cannot develop in a medium where the proportion of inactive or non-propagative sites in relation to the active or propagative sites is greater than or equal to a number which it is appropriate to call the percolation threshold. Thus let us take the example of FIG. 1, in which a combustible site such as a forest is divided into three zones, a first zone comprising exclusively combustible sites (11), a second zone (2) of width (L) comprising a random distribution of combustible sites (21) and non-combustible sites (20) (sites represented by hatched lines), the proportion of which is greater than the percolation threshold.

A third zone (3) consists like the first of exclusively combustible sites (31). It is has been found that a fire spreading in the direction of arrows (A) spreads in zone (1) and is stopped at the level of zone (2) when the proportion of non-propagative sites (20) in relation to the propagative sites (21) exceeds a certain percentage. In this case, the fire does not spread to the interior of zone (3) and the fire stops in zone (2).

Experience has shown that in the case of a threshold of between 25 and 60% for forest fires either a slowing or a stopping of the fire was achieved, depending on the wind conditions and on the threshold chosen. Preferably, when one wishes to stop a forest fire, in the absence of wind, one will chose a threshold equal to 42%. Advantageously, to have a percolation effect, for a given zone a number of propagative and non-propagative sites is required greater than 150 and the number of non-propagative sites must represent a proportion of between 25 and 60% of the total number of sites, which may represent an equivalent area or volume in the order of between 25 and 60% of the total area or volume of the zone in question.

The non-propagative sites will preferably consist either of non-combustible plants planted separately or in thickets among the existing natural vegetation. These plants will be chosen from the non-combustible species which are known or which may be developed later.

Another means of rendering the elements of a site non-propagative may consist of installing fixed spray heads or hydrants producing jets of fluid such as water or foam which may contain retardants. These hydrant or spray head elements are brought into action by manual control or automatically when the fire approaches and their distribution is such that the zones sprayed by these elements and rendered non-propagative correspond with the slowing-down threshold or with the stopping threshold of the fire mentioned above. A known automatic control operated from a fire detection device may control these spray heads.

It will easily be understood that the process of the invention may also be used for fighting fires in buildings by optimizing the number of spray heads and detection elements, in order to reduce the installation costs and to limit damage due to flooding of the premises. Similarly, the above principle, whereby combustible zones may be combined with non-combustible zones, may advantageously be used in the construction of houses. The quantity of non-combustible materials in houses may be limited, thus reducing construction costs without reducing safety and fire prevention.

Another method for rendering sites non-propagative may consist of bombs thrown or released downstream of the front of the fire, which, as they explode, disperse a fluid such as water or foam which may or may not contain retardants. This method for projecting fluid has the advantage of spraying the fluid from the bottom upwards thus taking into account the fractile nature of the vegetation, i.e. the arborescent shape of the plants. In this case spraying performed in the direction of the arborescence provides a much better damping down than that provided, for example, by the spraying or release of water from an aircraft.

Thus, the process used and the various means enabling the process to be put into practice by producing zones of non-propagative elements contribute to the optimization of fire fighting.

As seen above, the process of fire fighting consists of using non-propagative elements or of employing means for rendering the combustible elements non-propagative, so that the percentage of non-propagative sites which the fire is likely to encounter is greater than a given threshold of less than 100%.

The advantage of such a process using the percolation theory is that it may be used not only as a means of fighting the fire but also as a preventive element.

Other modifications within the reach of the specialist also form part of the spirit of the invention. Thus in the case where water bombs are used, a site may be neutralized by explosion among the vegetation of an envelope containing a specified quantity of water. This explosion is caused either by impact with the ground, or by remote control at a determined height in relation to the ground. In the case of explosion by impact on the ground, it is preferable to use bombs with a flexible envelope, whereas rigid envelopes serve in the case of remotely controlled explosions.

I claim:

1. A method of preventing the spread of fire comprising the steps of:

defining a combustible area having substantially continuous combustible material;

dividing said combustible area into three zones, a first zone and a second zone having a first shared border and a third zone and said second zone having a second shared border;

dividing said second zone into a plurality of site units, said plurality being greater in quantity than 150 site units;

defining a threshold percentage of non-propagative site units necessary to halt fire propagation through said second zone, the percentage of said plurality which are non-propagative site units being a percentage greater than the threshold percentage, but less than 100%, and said non-propagative site units being dispersed within said second zone; and treating said non-propagative site units such that said units do not burn readily whereby a fire front will not propagate to said second shared border.

2. The method according to claim 1, wherein the threshold is between 25% and 60%.

3. The method according to claim 2, wherein the non-propagative sites are defined by concentrations of non-combustible plants growing in the zone.

4. The method according to claim 2, wherein the non-propagative sites are produced by spraying an area with a non-combustible fluid.

5. The method according to claim 4, wherein the fluid is sprayed by spray heads.

6. The method according to claim 4, wherein the fluid is applied by placing sealed rupturable containers in the zone, whereby the fluid is sprayed when the containers are caused to explode.

7. The method according to claim 6, wherein the containers are placed by one of throwing and dropping into the zone.

8. The method according to claim 4, wherein the fluid is water.

9. The method according to claim 4, wherein the fluid is a foam.

10. The method according to claim 4, wherein the fluid contains fire retardants.

11. The method according to claim 1, wherein the threshold is substantially at least 42%, whereby propagation of a forest fire is stopped in absence of wind.

12. The method according to claim 1, wherein the zone is established within a building.

13. The method according to claim 1, wherein the zone is established in a forest.

* * * * *